US006131516A

United States Patent [19]

Sanford et al.

[11] Patent Number: 6,131,516

[45] Date of Patent: Oct. 17, 2000

[54] AIR-SAFED UNDERWATER FUZE SYSTEM FOR LAUNCHED MUNITIONS

[75] Inventors: Matthew J. Sanford, Bel Alton, Md.; Keith B. Lewis, King George, Va.

[73] Assignee: The United States of America as represented by the Secretary of the Navy, Washington, D.C.

[21] Appl. No.: 09/206,939

[22] Filed: Dec. 8, 1998

[51] Int. Cl.[7] ..... F42C 15/22

[52] U.S. Cl. ..... 102/239; 102/416; 102/229; 102/48

[58] Field of Search ..... 102/223, 263, 102/390, 399, 406, 416, 239, 229, 423, 428, 429; 114/20.1, 238

[56] References Cited

U.S. PATENT DOCUMENTS

| | | | |
|---|---|---|---|
| 2,660,952 | 12/1953 | Mohaupt | 102/204 |
| 3,765,331 | 10/1973 | Montesi | 102/416 |
| 3,765,332 | 10/1973 | Baker et al. | 102/416 |
| 4,100,855 | 7/1978 | O'Callaghan | 102/48 |

*Primary Examiner*—Charles T. Jordan
*Assistant Examiner*—M. Thomson
*Attorney, Agent, or Firm*—James B. Bechtel, Esq.; Peter J. Van Bergen, Esq.

[57] ABSTRACT

An air-safed underwater fuze system is provided for munitions that are to be launch-deployed and water-detonated. A housing defines a first bore contiguous with a second bore. Radial ports in the housing communicate with the first bore. A first piston is slidably mounted in the first bore and a second piston is slidably mounted in the second bore and positioned flush with the first bore. Piston control means are coupled between the munitions and first piston for positioning the first piston in a first position prior to launch in which the first piston seals off the radial ports while being spaced apart from the second piston to define a chamber. The piston control means moves the first piston at launch to a second position so that the chamber expands and the radial ports are in communication with the chamber. The piston control means further drives the first piston from its second position towards its first position at a specified time after launch. Once the first piston seals off the radial ports, the first piston pressurizes the water in the chamber. As a result, the second piston is driven along the second bore as actuating movement. A firing mechanism is provided in communication with the second bore and coupled to the munitions. The firing mechanism is responsive to the actuating movement of the second piston to generate detonation energy for the munitions.

20 Claims, 8 Drawing Sheets

AIR-SAFED UNDERWATER FUZE SYSTEM FOR LAUNCHED MUNITIONS

CROSS-REFERENCE TO RELATED PATENT APPLICATIONS

This patent application is co-pending with two related patent applications entitled "AIR-SAFED MECHANICAL WATER ACTUATOR" filed Sep. 19, 1998 as U.S. patent application Ser. No. 09/156,382, and "LOCK AND RELEASE MECHANISM" filed Dec. 15, 1998 as U.S. patent application Ser. No. 09/211,002, and, owned by the same assignee as this patent application.

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to fuzes or fuze systems for use with launched munitions, and more particularly to an air-safed underwater fuze system that is readied at launch and causes detonation only when submerged in water.

BACKGROUND OF THE INVENTION

In general, military specifications define a fuze or fusing system as a physical system designed to sense a target or respond to one or more prescribed conditions such as elapsed time, pressure or command, and initiate a train of fire or detonation in munitions. Safety and arming are primary roles performed by a fuze to preclude ignition of the munitions before the desired position or time. For example, if a munitions is an array of energetic charges launched from a watercraft into shallow (or deep) water to clear mines and obstructions, the fuze should ideally determine that launch and deployment occurred as intended before initiating detonation. Several fuzes designed to just prevent in-air detonation are known in the prior art.

U.S. Pat. Nos. 3,765,331 (the '331 patent) and 3,765,332 (the '332 patent) disclose water-armed air-safetied detonators in which a plurality of small explosives are aligned in a spaced-apart fashion in a fuze housing. The first of these small explosives is a delay charge which ignites when the ordnance is launched or released. The delay charge eventually burns and flashes down an adjacent housing bore to ignite a transfer charge. Detonation of the transfer charge releases energy that is either used to move a piston (the '331 patent) or is in the form of a shock wave (the '332 patent). This released energy is delivered to a chamber that is flooded with either air or water depending on the environment in which the fuze is immersed. Adjacent the flooded chamber is a firing pin/percussion primer (the '331 patent) or just a percussion primer (the '332 patent). If the flooded chamber is filled with air, the released energy in the form of a moving piston (the '331 patent) or shock wave (the '332 patent) will not transfer through to the next stage of the fuze. If, however, the fuze is submerged in water, the flooded chamber is filled with water and the released energy entering the flooded chamber is transferred therethrough to the next stage of the fuze.

Although being air-safed, these devices still have several disadvantages. Use of stored energy (i.e., explosive material) for arming and firing is considered bad design practice because the energy is available at all times during storage and transportation, and may therefore be released due to unforeseen causes or situations. The use of explosives as part of the fuze train can be inherently problematic. These problems range from the safety concerns related to the construction and storage of such devices to the fact that these fuzes are not reusable.

To overcome the problems inherent with the use of explosives, a mechanical underwater firing mechanism is disclosed in U.S. Pat. No. 2,660,952. Briefly, a spring-loaded plunger is mounted in a housing. The head of the plunger is formed with a recess. Fitted in the housing coaxial with the plunger is a plug having a central bored portion in which a firing pin is temporarily positioned intermediately therein by a shear pin. As a result, small chambers are defined in the central bored portion on either side of the firing pin. The central bored portion of the plug opposes the plunger's recess and is sized at its exterior to fit within the recess. When the spring-loaded plunger is cocked, the head of the plunger is spaced apart from the central bored portion of the plug to define a chamber within the housing. An opening in the side of the housing at the chamber allows the environment surrounding the housing (e.g., air or water) to fill the chamber.

When the spring-loaded plunger is released, the plunger recess envelops the central bored portion of the plug to compress any fluid trapped in the small chamber of the central bored portion between the firing pin and the head of the plunger. If the trapped fluid is air, the compression thereof will not develop forces sufficient to cause the shear pin to fail. However, if the trapped fluid is water, the compression forces imparted by the plunger will be sufficient to cause failure of the shear pin thereby allowing movement of the firing pin to impact a primer.

While eliminating the use of explosives in the firing mechanism, this device has other disadvantages. For example, the requirement that a small chamber be defined in the central bored portion opposing the head of the plunger raises the possibility that an air bubble will form therein when the device is submerged in water. The presence of such an air bubble could prevent the mechanism from functioning underwater. At the same time, the requirement that the small chamber be present in the central bored portion could also bring about an unwanted firing. This could occur if the mechanism were not cocked and inadvertently dropped in water. Water could seep into the mechanism and fill the small chamber. Then, an in-air release of the (cocked) plunger could bring about movement of the firing pin just as if the mechanism were submerged in water. Another disadvantage brought about by the requirement of the small chamber arises in sub-freezing environments. Specifically, water in the small chamber could quickly freeze due to its small volume. If this occurs, the mechanism will not function.

SUMMARY OF THE INVENTION

Accordingly, it is an object of the present invention to provide an air-safed underwater fuze for launched munitions.

Another object of the present invention is to provide an air-safed underwater fuze for launched munitions that is readied only at time of launch.

Still another object of the present invention is to provide an air-safed underwater fuze that can initiate detonation only when submerged in water.

Other objects and advantages of the present invention will become more obvious hereinafter in the specification and drawings.

In accordance with the present invention, a fuze system is provided for munitions that are to be launch-deployed and water-detonated. A housing defines a first bore contiguous with a second bore. One or more radial ports formed in the housing allow an environment about the housing to communicate with the first bore. A first piston is slidably mounted in the first bore and a second piston is slidably mounted in the second bore and positioned flush with the first bore. Piston control means are coupled between the munitions and first piston for positioning the first piston in a first position prior to launch. In the first position, the first piston seals off the radial port(s) while being spaced apart from the second piston so that a chamber in the first bore is defined between the first and second piston. The piston control means moves the first piston at launch to a second position so that the chamber expands and the radial port(s) are in communication with the chamber. As a result, fluid in the environment about the housing can fill the chamber. The piston control means further drives the first piston from its second position towards its first position at a specified time after launch. Once the first piston seals off the radial port(s), the first piston pressurizes the fluid in the chamber. If the fluid is water, the second piston is driven along the second bore as actuating movement. A firing mechanism is provided in communication with the second bore and coupled to the munitions. The firing mechanism is responsive to the actuating movement of the second piston to generate detonation energy for the munitions.

DETAILED DESCRIPTION OF THE INVENTION

Figure 1:
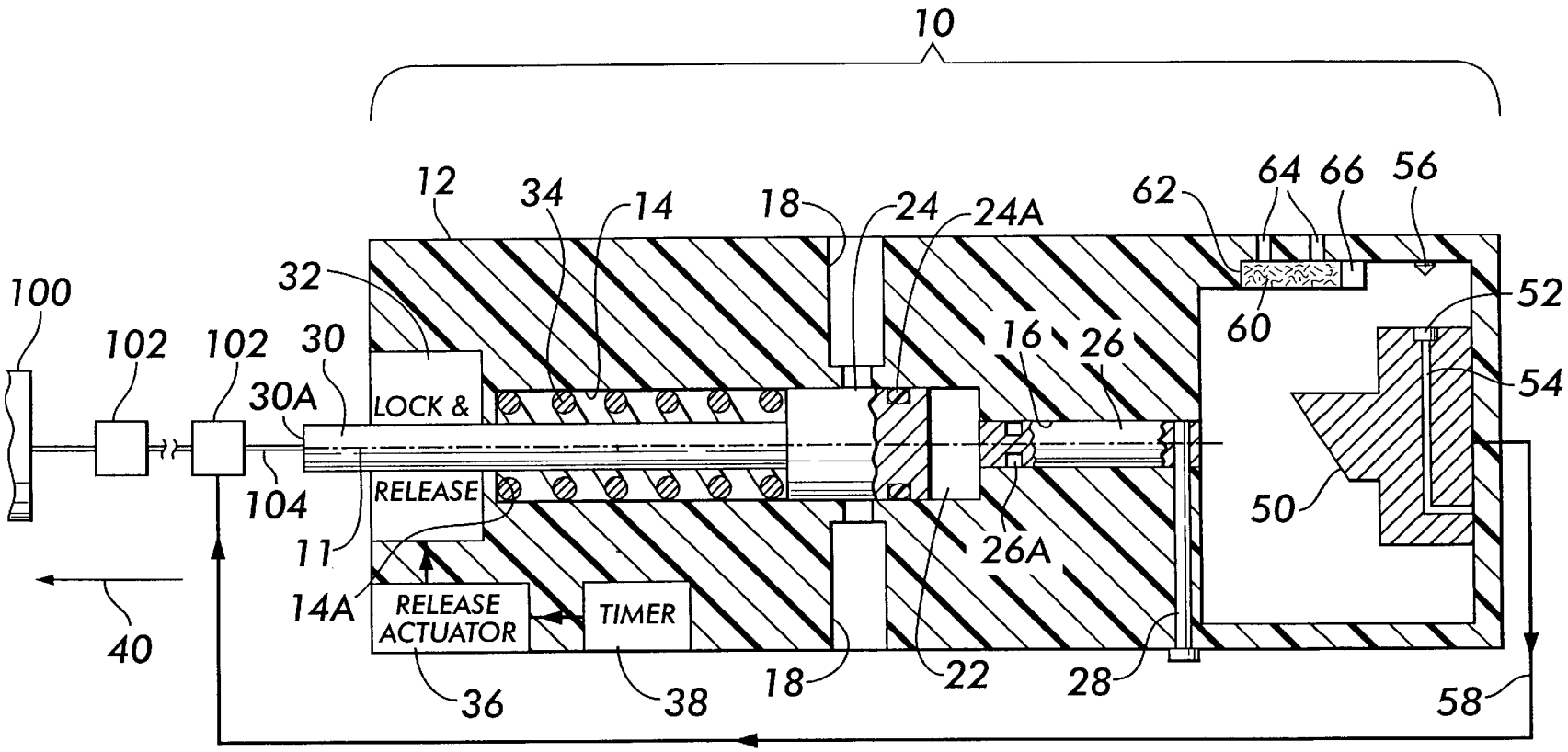
FIG. 1 is a side sectional view of an embodiment of the air-safed underwater fuze system of the present invention in its at-rest state.

Referring now to the drawings, FIGS. 1–4 depict an operational sequence of the fuze system of the present invention for use with launched munitions. Accordingly, the reference numerals will be the same for the common elements in each of the views. The fuze system is referenced generally by numeral 10. By way of example, fuze system 10 is coupled inline with a projectile 100 and one or more line charges 102 to be detonated in a water environment. Projectile 100 can receive its launch power from a launcher (not shown) or can be capable of self-propulsion via rockets, motors, etc. Charges 102 are main charges which are generally insensitive and require specific initiation provided by fuze system 10 at the appropriate time.

Also, by way of example, fuze system 10 is illustrated and will be described for use in harsh environmental conditions where sub-freezing air (e.g., on the order of 0° F. or less) and seawater (e.g., on the order of 27–29° F.) temperatures are expected. Note that the freezing temperature of seawater is generally less than 32° F. and can be considerably lower depending on salinity. However, it is to be understood that the present invention is not limited to use in such harsh environmental conditions.

The pre-launch or at-rest state of fuze system 10 illustrated in FIG. 1 will be referred to first to describe the component parts thereof. A rigid housing 12 defines a first bore 14 and a second bore 16 therein. Bores 14 and 16 are adjoined and can be coaxially-aligned with one another along longitudinal axis 11 as in the illustrated embodiment. However, bores 14 and 16 could also be offset slightly with respect to their longitudinal axis or be angularly disposed with respect to one another. In the illustrated embodiment, the diameter of bore 14 is larger than that of bore 16 such that the cross-sectional area of bore 14 is at least several times that of bore 16. In some applications, bores 14 and 16 could have the same diameter. Also defined in housing 12 are one or more ports 18 linking the exterior of housing 12 with bore 14. Typically, ports 18 extend radially outward from bore 14 about the circumference of housing 12.

Disposed within bore 14 is a piston 24 mounted for sealed but sliding engagement in bore 14 in any of the conventional ways known in the art. For example, a ring seal (not shown for sake of clarity) can be retained in a circumferential notch 24A of piston 24. In the at-rest position, piston 24 is positioned such that ports 18 are sealed with respect to bore 14 and a chamber 22 is defined in bore 14 between piston 24 and the start of bore 16. The sealing of chamber 22 from ports 18 is insured by notch 24A (holding a ring seal) being positioned between ports 18 and the end of piston 24 facing chamber 22. The reasons for sealing off ports 18 from chamber 22 in this at-rest position will be explained in detail below.

Disposed in bore 16 is another piston 26 mounted for sealed but sliding engagement in bore 16. Accordingly, a ring seal (not shown for sake of clarity) can be retained in a circumferential notch 26A of piston 26. Note that the ring seal in notch 26A completes the sealing of chamber 22 between pistons 24 and 26. In the at-rest position, piston 26 is positioned so that it is flush with bore 14 for reasons that will be explained in detail below. Retention of piston 26 in the at-rest position can be passive (i.e., by means of the sealing strength of the ring seal in notch 26A) or can be active as illustrated. More specifically, the at-rest position of piston 26 can be maintained by providing a shear pin 28 coupling piston 26 to housing 12. In the illustrated example, shear pin 28 is inserted through housing 12 for ease of assembly. Other types of positioners (e.g., spring) or safety restraints can be used as long as they fail or yield at the appropriate time as will be explained further below.

Coupled to or integral with (as shown) piston 24 is a piston rod 30 that extends back through bore 14 and out of housing 12. Outboard end 30A of piston rod 30 is mechanically coupled to the last of line charges 102 either directly or via a lanyard 104 as in the illustrated embodiment. A lock and release mechanism 32 positioned in (as shown) or out of housing 12 is provided for engaging or disengaging from piston rod 30. Lock and release mechanism 32 is a mechanical device such as a ball lock type device. One suitable lock and release mechanism is disclosed in the afore-mentioned co-pending patent application entitled "LOCK AND RELEASE MECHANISM" U.S. patent application Ser. No. 09/211,002, the contents of which are hereby incorporated by reference.

In order to mechanically load piston 24, a spring 34 is provided in bore 14 about piston rod 30. Specifically, spring 34 is captured between piston 24 and the terminal end 14A of bore 14. To position piston 24 in its at-rest position, lock and release mechanism 32 is disengaged from piston rod 30 and spring 24 is selected to have an at-rest or maximum travel state that properly positions piston 24 as described above. A release actuator 36 is coupled to lock and release mechanism 32 and a timer 38 is coupled to release actuator 36. In general, timer 38 is configured to countdown a specified time period. At the conclusion of the specified time period, release actuator 36 activates the release mechanism of lock and release mechanism 32 which, in turn, will then disengage from piston rod 30.

Figure 2:
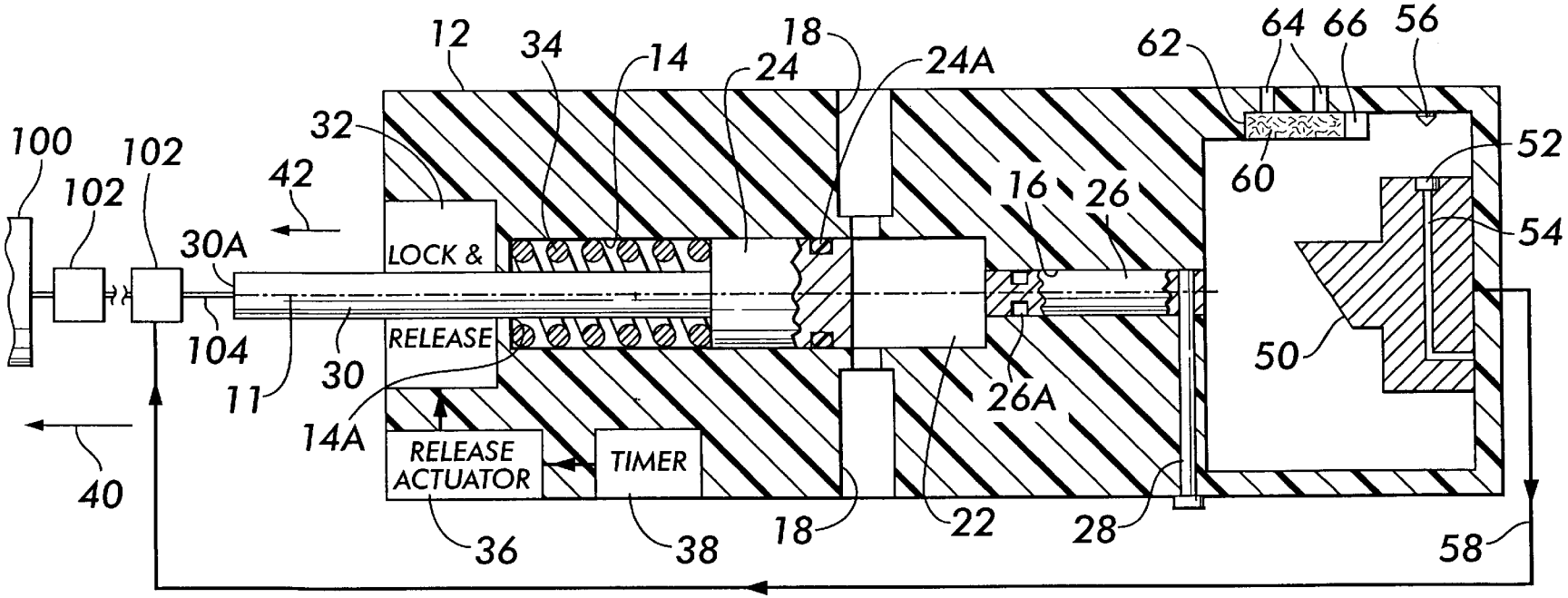
FIG. 2 is a side sectional view of the fuze system in its readied state.

Operation of fuze system 10 will now be explained beginning with the at-rest position illustrated in FIG. 1. In this position, spring 34 is at-rest and chamber 22 is sealed from the outside environment. At launch, projectile 100 and line charges 102 begin to move in the direction of arrow 40. As the last line charge 102 takes off, lanyard 104 is placed in tension. In turn, piston rod 30 is extracted from housing 12 in the direction of arrow 42 as depicted in FIG. 2 to draw piston 24 along bore 14 and compress spring 34. Spring 34 thus supplies a potential energy bias to piston 24. Lock and release mechanism is designed to lock onto piston rod 30 once spring 34 is compressed thereby maintaining piston 24 in its ready state. Timer 38 can be activated to start its countdown either at launch or once lock and release mechanism 32 locks onto piston rod 30.

The length of bore 14 and configuration of spring 34 are designed to allow piston 24 to clear ports 18 as piston rod 30 is extracted from housing 12 by lanyard 104. As chamber 22 expands, ports 18 communicate therewith as shown in FIG. 2. Once housing 12 is submerged in water, the water is admitted into (expanded) chamber 22 via ports 18.

Figure 3:
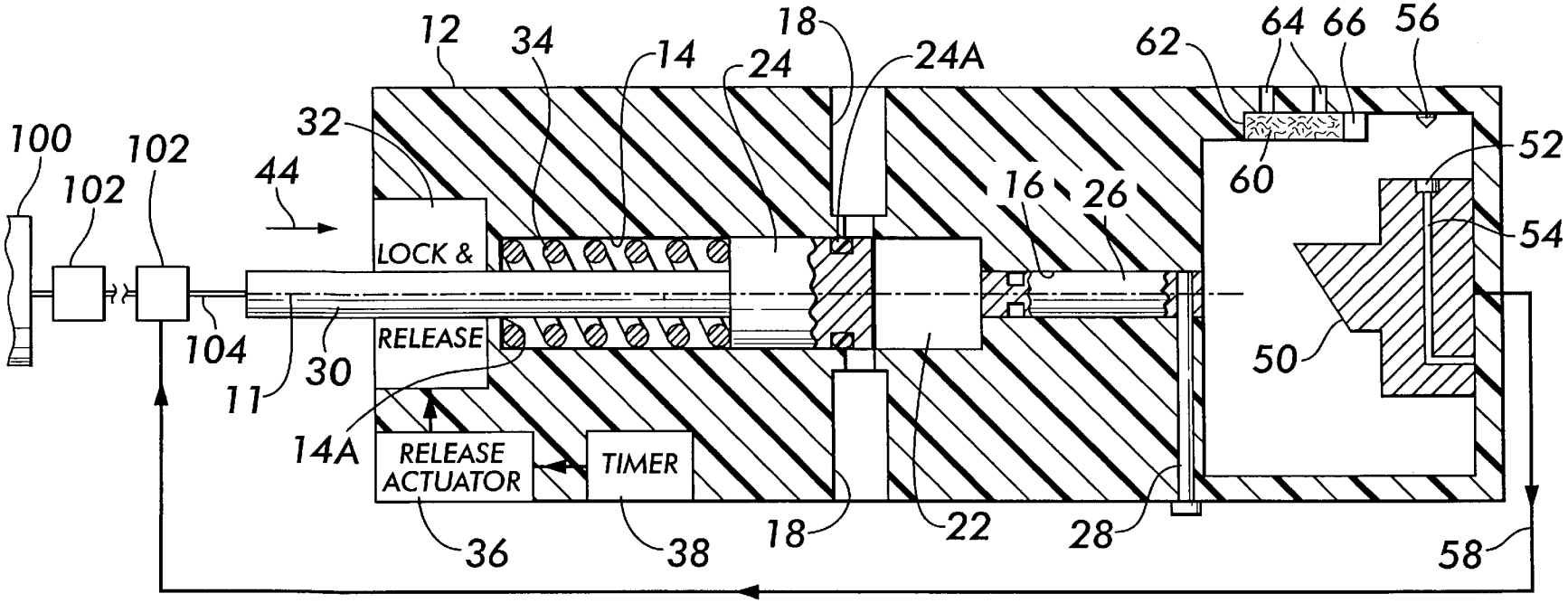
FIG. 3 is a side sectional view of the fuze system in transition from its readied state to its at-rest state.
Figure 4:
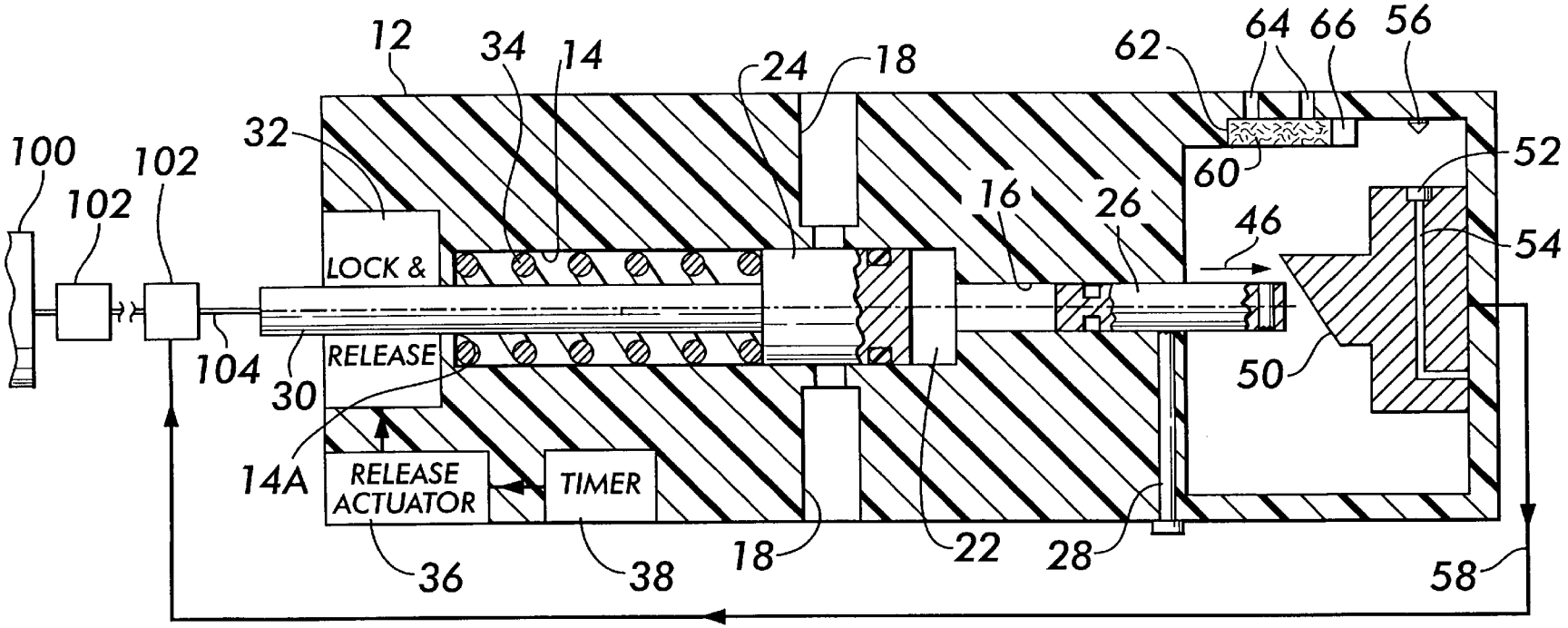
FIG. 4 is a side sectional view of the fuze system after transition from its readied state to its at-rest state assuming the fuze is submerged in water.

Timer 38 is pre-set to countdown the expected time it takes for line charges 102 to reach their destination in water. At the conclusion of this time, release actuator 36 activates the release mechanism of lock and release mechanism 32. Lock and release mechanism 32 is thus disengaged from piston rod 30 with spring 34 compressed as in FIG. 2. Once this occurs, piston 24 begins to move in the direction of arrow 44 (as depicted in FIG. 3) under the bias force of spring 34 which is in transition to its at-rest state. After piston 24 has again sealed off ports 18 as in FIG. 3, the water in chamber 22 is pressurized. The pressure in chamber 22 builds against piston 26 until shear pin 28 fails. At this point, as illustrated in FIG. 4, piston 26 is driven along bore 16 in the direction of arrow 46. The movement of piston 26 is used to trigger the fuze system's firing mechanism.

While a variety of firing mechanisms could be incorporated into fuze system 10, one firing mechanism currently in use by the U.S. Navy will be described by way of example. Briefly, a wedge 50 incorporates a detonator 52 and lead line 54, and is mounted in housing 12 such that wedge 50 is constrained to transverse movement relative to the axial movement of piston 26. More specifically, wedge 50 moves transverse to piston 26 when struck thereby. Such transverse movement of wedge 50 causes detonator 52 to be impaled by a firing pin 56 mounted in housing 12. At the same time, the transverse movement of wedge 50 causes lead line 54 to become aligned with a detonating cord 58 that leads to line charges 102. Firing pin 56 fires detonator 52 to generate detonation energy which is transported to line charges 102 via lead line 54 and detonating cord 58.

The present invention can also include fuze sterilization to prevent failed or dud systems from existing as an on-going hazard to innocent or retrieval personnel. That is, should some portion of fuze system 10 fail such that wedge 50 does not move at the appropriate time, the fuze sterilization would permanently prevent detonator 52 from being impaled by firing pin 56. By way of illustrative example, fuze sterilization can take the form of water-absorbent fibers (e.g., cotton fibers) compressed into a pellet 60 (or a stack of pellets) mounted in a chamber 62 in housing 12. Ports 64 are provided in housing 12 to lead water to pellet 60 when housing 12 is submerged in water. Pellet 60 is positioned and configured to expand (e.g., axially in the direction of arrow 48) via water absorption to block movement of wedge 50 that might allow detonator 52 to strike firing pin 56. Because the expansion of compressed cotton fibers due to water absorption is relatively slow, pellet 60 can be designed to expand over a period of time that is longer than it should take for fuze system 10 to function properly. Pellet 60 can terminate in a hard tip 66 that shrouds firing pin 56 when pellet 60 expands to further guarantee that firing pin 56 cannot contact detonator 52.

The technical constraint for preventing entrapment of air bubbles in chamber 22 when housing 12 is submerged in water is defined in terms of an L/D ratio where L is the length of chamber 22 in the ready position (FIG. 2) and D is the diameter of piston 24. If the L/D ratio is large, e.g., one or greater, there is a greater chance of entrapping air bubbles in chamber 22 than if the L/D ratio is less than one. The L/D ratio used in successful tests of the present invention was approximately 0.375.

If housing 12 is surrounded by a compressible fluid (e.g., air) while in its ready state shown in FIG. 2, piston 26 will not be driven along bore 16 when lock and release mechanism 32 is disengaged from piston rod 30. This is because air is compressible and because the volume of chamber 22 is large enough to hold the pressurized air even when piston 24 has fully transitioned from the ready position (FIG. 2) to the at-rest position (FIG. 4).

The advantages of the present invention are numerous. The fuze system is fully mechanical and therefore presents no safety concerns for the assembly, storage and usage thereof. In addition, the fuze system is not readied for operation until launch and only permits detonation when submerged in water.

As illustrated, fuze system 10 is constructed for reliable use in harsh environmental conditions where the air is 0° F. or less while the water (e.g., seawater) temperature is at or close to its freezing point, i.e., typically on the order of 27–29°F. In order to prevent the formation of ice in bore 14 or on piston 24, materials used for at least housing 12 and piston 24 should have a low thermal conductivity. Piston 26 and piston rod 30 could also be made of the same material as illustrated. For purpose of the present invention, low thermal conductivity is defined as a material that does not support the formation of ice thereon when cooled to a sub-freezing temperature prior to submergence in freezing seawater. Suitable materials are a variety of plastics such as acetal which is a thermoplastic material with inherent lubricating qualities. Acetal is manufactured by DuPont de Nemours, E. I. and Co. under the trademark Delrin. Materials such as these possess thermal conductivities that are approximately 100 times less than the thermal conductivities of most metals which are susceptible to having ice form thereon when subjected to the conditions described above.

Figure 5A:
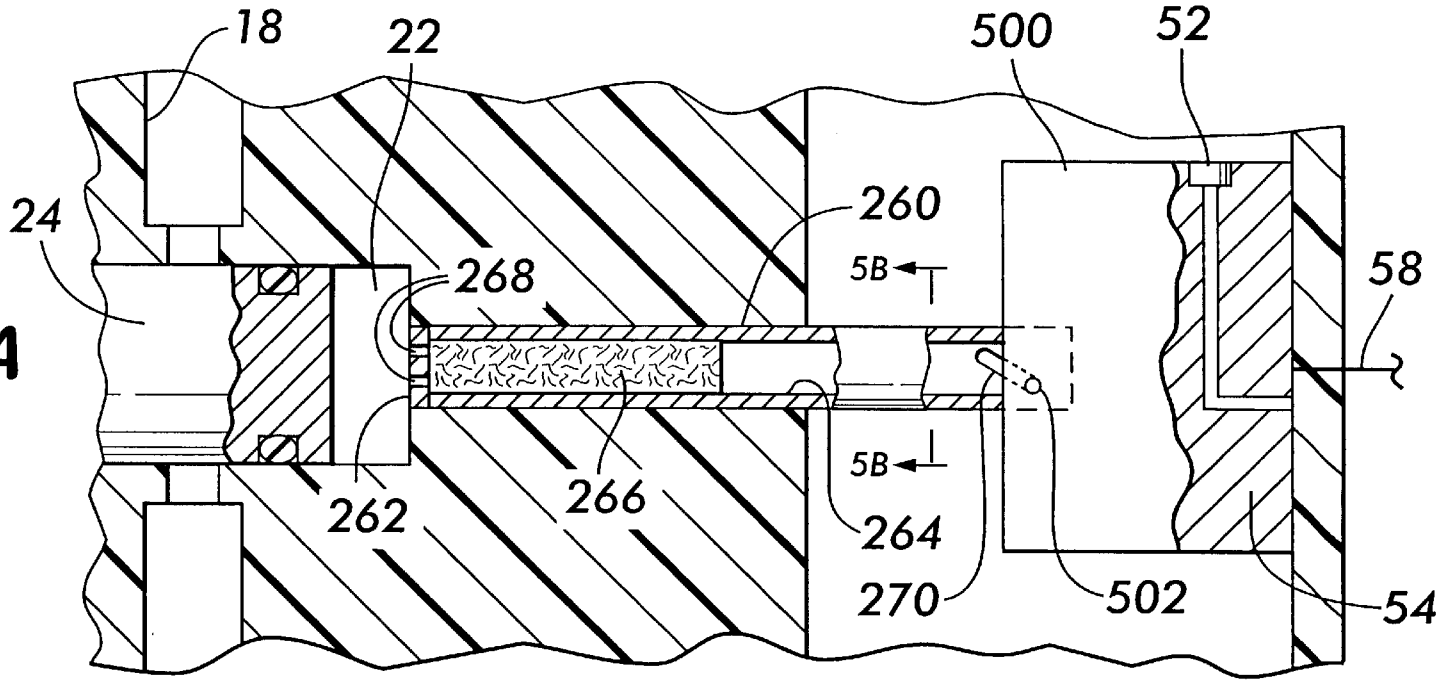
FIG. 5A is an enlarged partial side sectional view of another embodiment of the piston used to trigger the fuze system's firing mechanism.
Figure 5B:
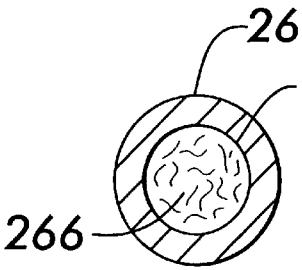
FIG. 5B is a sectional view taken along line 5—5 of FIG. 5A.

Although the invention has been described relative to a specific embodiment thereof, there are numerous variations and modifications that will be readily apparent to those skilled in the art in light of the above teachings. For example, piston 26 and wedge 50 could be directly coupled to one another and incorporate fuze sterilization as shown in FIGS. 5A and 5B where piston 260 replaces piston 26 and wedge 500 replaces wedge 50. Common elements are referenced with the same numerals as the embodiment illustrated in FIGS. 1–4. Structurally, piston 260 is circularly-shaped at end face 262 opposing piston 24. Piston 260 is hollow along the remainder of its length to define a longitudinal sleeve 264. Fitted in sleeve 264 adjacent end face 262 is a water-absorbent fiber (e.g., cotton) pellet 266. Ports 268 feed through end face 262 to couple chamber 22 with pellet 266. A slot 270 is formed through sleeve 264 in the other end of piston 260. A slide pin 502 mounted on wedge 500 fits in slot 270.

In operation of this embodiment, when water fills chamber 22, water is also admitted through ports 268 to pellet 266 causing pellet 266 to slowly expand axially along sleeve 264. If all parts of the fuze system function properly, water in chamber 22 is pressurized by piston 24 and piston 260 moves to the right before pellet 266 can expand. Rightward movement of piston 260 causes wedge 500 to move upward as pin 502 slides in slot 270. However, if some part of the fuze system fails so that piston 24 does not pressurize the water in chamber 22 in the prescribed timely fashion, pellet 266 expands axially and will eventually press against wedge 500 to prevent any rightward movement of piston 260. The advantages of this embodiment include the direct coupling of piston 260 and wedge 500 as well as the compact way fuze sterilization is incorporated therein.

Figure 6A:
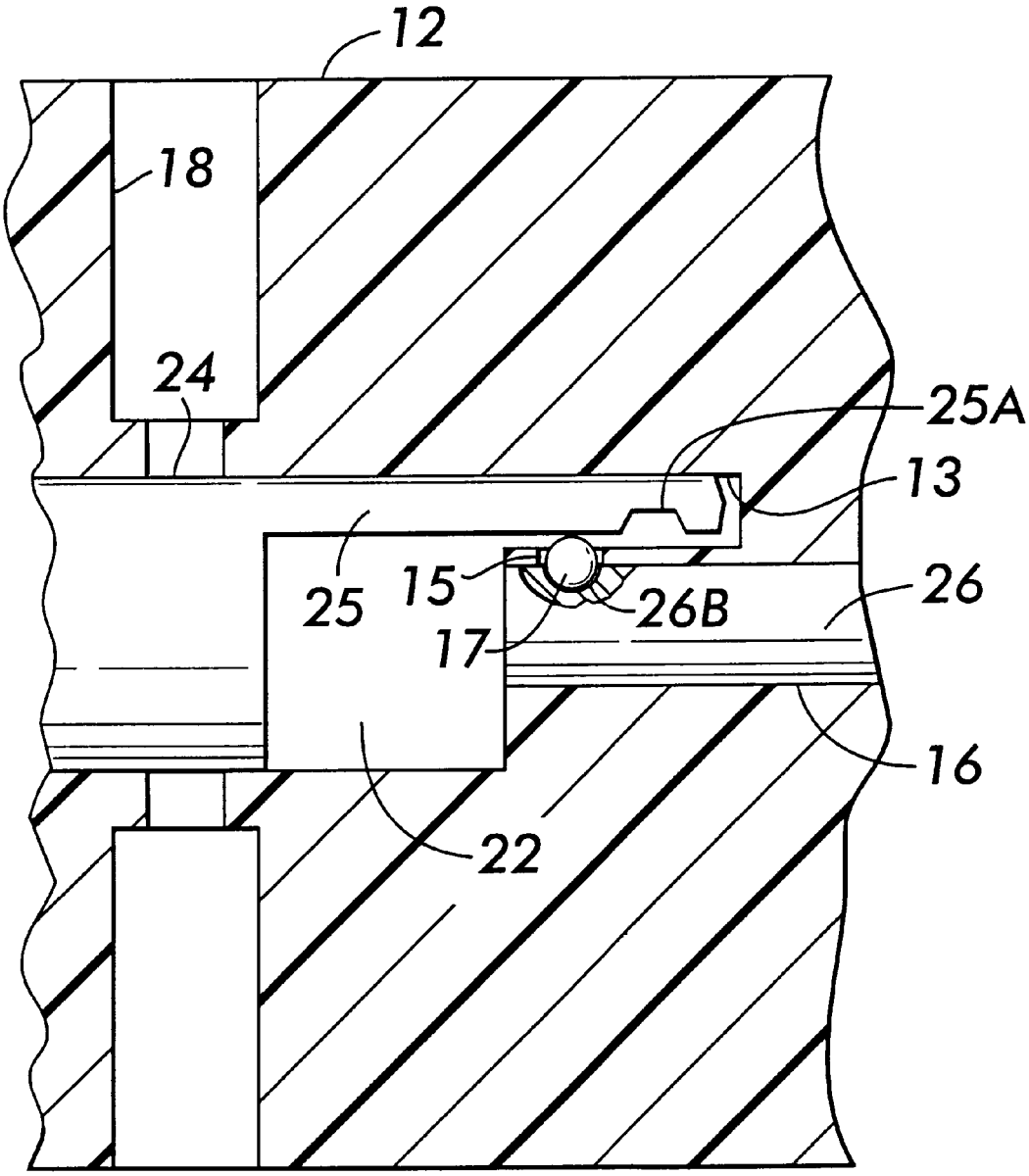
FIG. 6A is an enlarged partial side sectional view depicting another embodiment of a piston safety restraining mechanism when the fuze system is at-rest.
Figure 6B:
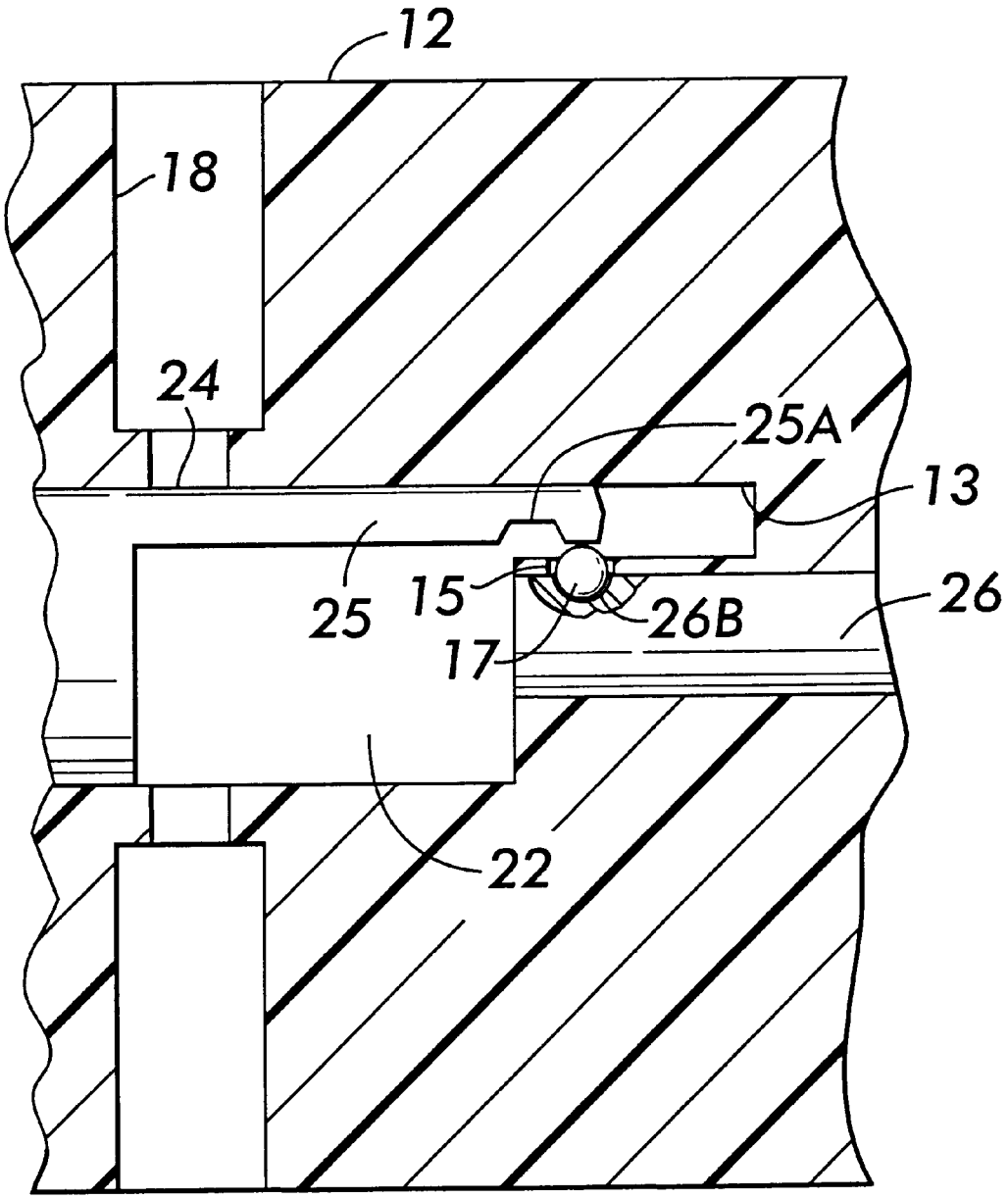
FIG. 6B is the piston safety restraining mechanism of FIG. 6A when the fuze system is in its readied state.
Figure 6C:
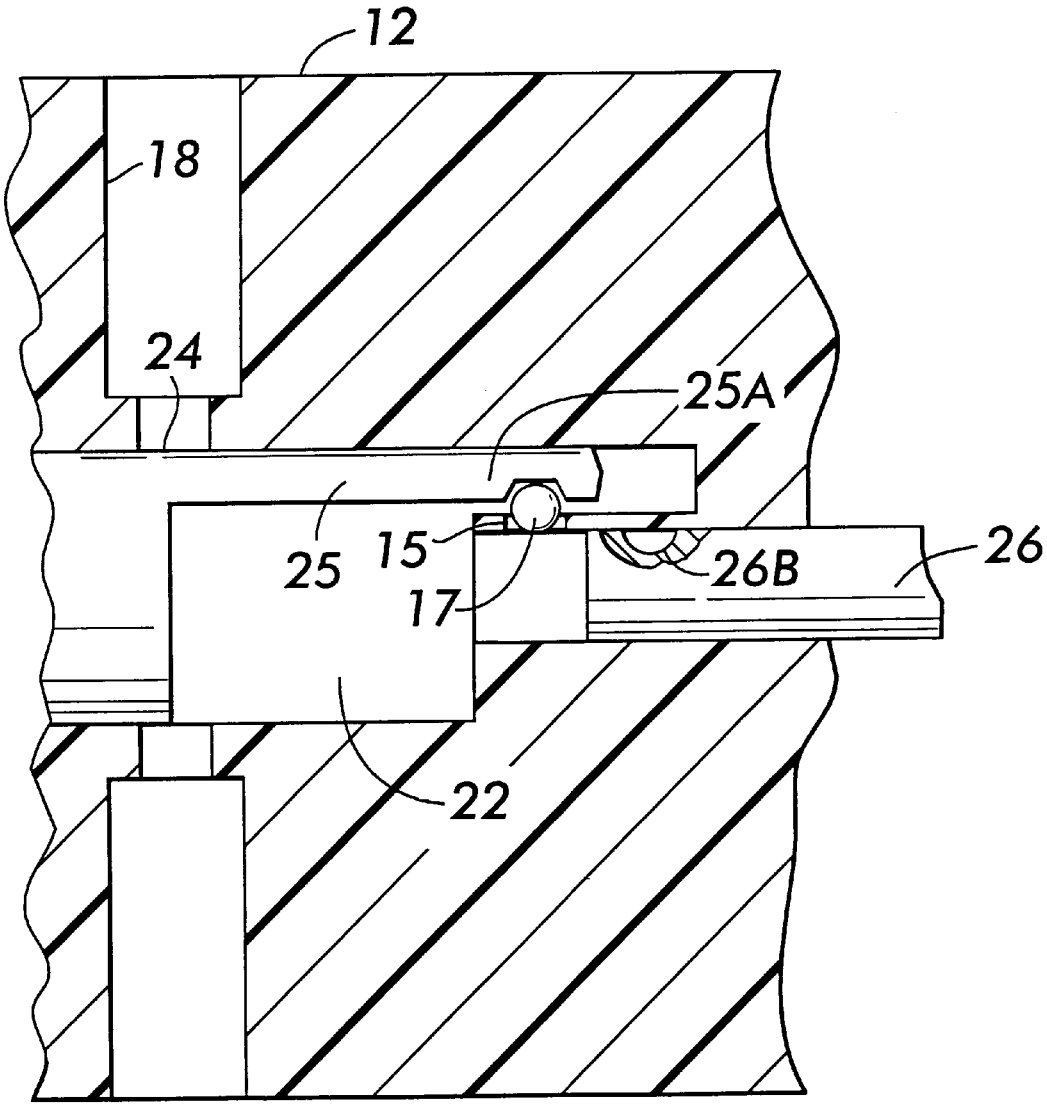
FIG. 6C is the piston safety restraining mechanism of FIG. 6A when the fuze system has been activated.

As mentioned above, other forms of safety restraint can be provided to cooperate with piston 26. On such alternative is illustrated in FIGS. 6A–6C. Structurally, piston 24 is provided with a locking flange 25 that is attached to or integral with piston 24. Flange 25 extends through chamber 22 and into a recess 13 of housing 12 that is parallel to bore 16. Flange 25 should be capable of slight flexing movement in the radial direction of piston 24 for reasons that will become apparent below. Flange 25 has an oblique angle notch 25A formed therein that faces towards piston 26. A sleeve 15 is formed in housing 12 to couple recess 13 with bore 16. Housed in sleeve 15 is a lock ball 17. Finally, piston 26 is notched at 26B to receive lock ball 17 in both the at-rest (FIG. 6A) and readied (FIG. 6B) states as will now be explained.

In FIG. 6A, the fuze system is at-rest so that chamber 22 is sealed and flange 25 is positioned to press lock ball 17 into notch 26B thereby positively restraining piston 26. When the fuze system is readied as illustrated in FIG. 6B, flange 25 still presses lock ball 17 into notch 26B. Note that even though oblique angle notch 25A momentarily passes over lock ball 17, three is no spring-loading on lock ball 17 that would cause same to move radially outward. In FIG. 6C, piston 24 has been released with water in chamber 22. Pressure on piston 26 builds and rightward movement thereof is possible as soon as oblique angle notch 25A is aligned over sleeve 15. That is, the tendency of piston 26 to move right presses lock ball 17 radially outward as illustrated.

In light of the above description, it will therefore be understood that, within the scope of the appended claims, the invention may be practiced other than as specifically described.

What is claimed as new and desired to be secured by letters patent of the united states is:

1. A fuze system for munitions that are to be launch-deployed and water-detonated, comprising:

a housing defining a first bore and second bore contiguous with said first bore, said housing further defining at least one radial port allowing an environment about said housing to communicate with said first bore;

a first piston slidably mounted in said first bore;

a second piston slidably mounted in said second bore and positioned flush with said first bore;

piston control means coupled between said munitions and said first piston for positioning said first piston is a first position prior to launch, said first position defined by said first piston sealing off said at least one radial port while being spaced apart from said second piston wherein a chamber in said first bore is defined between said first piston and said second piston, said piston control means moving said first piston at launch to a second position wherein said chamber expands so that said at least one radial port is in communication with said chamber and wherein fluid in said environment about said housing can fill said chamber, said piston control means further driving said first piston from said second position towards said first position at a specified time after launch wherein, after said first piston seals off said at least one radial port, said first piston pressurizes said fluid in said chamber wherein, when said fluid is water, said second piston is driven along said second bore as actuating movement; and a firing mechanism in communication with said second bore and coupled to said munitions, said firing mechanism being responsive to said actuating movement to generate detonation energy for said munitions.

2. A fuze system as in claim 1 further comprising a positioner coupled to said second piston for restraining said second piston flush with said first bore until said first piston moves in said first bore to seal off said at least one radial port and subsequently pressurize said fluid in said chamber.

3. A fuze system as in claim 1 wherein said at least one radial port comprises a plurality of radial ports disposed circumferentially about said housing.

4. A fuze system as in claim 1 wherein said second bore has a smaller diameter than said first bore.

5. A fuze system as in claim 1 wherein said first bore and said second are coaxial.

6. A fuze system as in claim 1 wherein said first piston has a diameter D and an axial length L of said chamber is defined when said first piston is in said second position such that L/D is less than one.

7. A fuze system as in claim 1 wherein said piston control means includes a timer for counting down said selected time.

8. A fuze system as in claim 1 wherein said firing mechanism moves in response to said actuating movement to a detonation position at which said detonation energy is generated, said fuze system further comprising a fuze sterilizer for preventing said firing mechanism from achieving said detonation position after said selected time has lapsed.

9. A fuze system as in claim 8 wherein said fuze sterilizer comprises compressed water-absorbent fibers positioned in said fuze system to communicate with said fluid.

10. A fuze system as in claim 9 wherein said compressed water-absorbent fibers are made of cotton.

11. A fuze system for munitions that are to be launch-deployed and water-detonated, comprising:

a housing defining a first bore and a second bore contiguous with said first bore, said housing further defining at least one radial port allowing an environment about said housing to communicate with said first bore;

a first piston slidably mounted in said first bore;

a second piston slidably mounted in said second bore and positioned flush with said first bore;

a mechanical loading mechanism coupled between said munitions and said first piston that, prior to launch, positions said first piston in a first position defined by said first piston sealing off said at least one radial port while being spaced apart from said second piston wherein a chamber in said first bore is defined between said first piston and said second piston, and that at launch, positions said first piston in a second position wherein said chamber is expanded so that said at least one radial port is in communication with said chamber so that water fills said chamber when said housing is submerged therein, said first piston having a potential energy bias towards said second piston when in said second position;

a lock and release mechanism coupled to said mechanical loading mechanism for restraining said mechanical loading mechanism when said first piston achieves said second position and for releasing said mechanical loading mechanism after a specified period of time wherein said potential energy bias causes said first piston to move towards said first position wherein, after said first piston seals off said at least one radial port, said first piston pressurizes said water in said chamber to drive said second piston along said second bore as actuating movement; and a firing mechanism in communication with said second bore and coupled to said munitions, said firing mechanism being responsive to said actuating movement to generate detonation energy for said munitions.

12. A fuze system as in claim 11 further comprising a positioner coupled to said second piston for restraining said second piston flush with said first bore until said first piston moves in said first bore to seal off said at least one radial port and subsequently pressurize said water in said chamber.

13. A fuze system as in claim 11 wherein said at least one radial port comprises a plurality of radial ports disposed circumferentially about said housing.

14. A fuze system as in claim 11 wherein said second bore has a smaller diameter than said first bore.

15. A fuze system as in claim 11 wherein said first bore and said second are coaxial.

16. A fuze system as in claim 11 wherein said first piston has a diameter D and an axial length L of said chamber is defined when said first piston is in said second position such that L/D is less than one.

17. A fuze system as in claim 11 further comprising a timer for counting down said specified time.

18. A fuze system as in claim 11 wherein said firing mechanism moves in response to said actuating movement to a detonation position at which said detonation energy is generated, said fuze system further comprising a fuze sterilizer for preventing said firing mechanism from achieving said detonation position after said specified time has lapsed.

19. A fuze system as in claim 18 wherein said fuze sterilizer comprises compressed water-absorbent fibers positioned in said fuze system to be exposed to water when said housing is submerged therein.

20. A fuze system as in claim 19 wherein said compressed water-absorbent fibers are made of cotton.

* * * * *